US005078509A

United States Patent [19]

Center et al.

[11] Patent Number: 5,078,509

[45] Date of Patent: Jan. 7, 1992

[54] RESEALABLE PACKAGE

[75] Inventors: John L. Center, Dallas, Tex.; Paul R. Schmidt, Neenah, Wis.

[73] Assignee: Recot, Inc., Plano, Tex.

[21] Appl. No.: 590,702

[22] Filed: Sep. 28, 1990

[51] Int. Cl.[5] ..... B65D 33/20

[52] U.S. Cl. ..... 383/88; 383/62; 383/89; 383/107

[58] Field of Search ..... 383/62, 82, 83, 85, 383/88, 89, 90, 95, 107, 905, 11; 206/806

[56] References Cited

U.S. PATENT DOCUMENTS

| | | | |
|---|---|---|---|
| 1,133,911 | 3/1915 | Barnard | 383/62 |
| 1,164,688 | 12/1915 | Whritehour | 383/62 |
| 1,619,887 | 3/1927 | Sapp | 383/62 |
| 2,062,618 | 12/1936 | Sterling | 383/88 X |
| 3,214,080 | 10/1965 | Wolfson | 206/806 X |
| 3,309,006 | 3/1967 | Perry et al. | 383/107 X |
| 3,313,471 | 4/1967 | Dickard et al. | 383/89 X |
| 3,314,591 | 4/1967 | Cheeley | 383/107 X |
| 4,428,477 | 1/1984 | Cristofolo | 383/89 X |

*Primary Examiner*—Stephen Marcus
*Assistant Examiner*—Jes F. Pascua
*Attorney, Agent, or Firm*—Rothwell, Figg, Ernst & Kurz

[57] ABSTRACT

A resealable package for snack food items and a method of making the same from a sheet of flexible material. Two side edges of the sheet are joined together in a seam, with a flap extending longitudinally from an exterior surface of the package. A resealable adhesive is disposed beneath the flap, whereby the flap serves as a release strip to protect the adhesive until use. The consumer re-closes the package by removing the release strip to expose the adhesive. The package then is folded downward a number of times until the exterior surface of the package is secured to the adhesive.

11 Claims, 3 Drawing Sheets

RESEALABLE PACKAGE

FIELD OF THE INVENTION

The present invention relates to flexible packages for snack food items, such as potato chips and the like, that can be resealed after opening to preserve the freshness of the product within. More particularly, the invention provides a flexible package including an integral adhesive seal strip disposed beneath a rear seam flap of the package.

BACKGROUND OF THE INVENTION

Savory snack food items, such as potato chips, corn chips and popcorn, are highly sensitive to oxygen and moisture and tend to rapidly become stale if exposed to room air for even a relatively short period of time. Savory snack food items are usually packaged in bags manufactured from a flexible film material having inherent moisture- and oxygen-barrier properties. Examples of suitable materials include waxed paper, metal foil, thermoplastic film and the like. Frequently, snack food packages are constructed from a laminate film consisting of a plurality of layers. While the respective layers may have a variety of properties, at least one layer is selected so as to provide each of the needed moisture and oxygen barrier properties.

The flexible film materials frequently used in constructing snack food packages are resistant to folding, and have a property often referred to as "memory." Thus, simply folding or rolling the open upper end of the package does not function to create an airtight (and moisture-tight) seal. As is well known by the consumer, the folded bag tends to unfold to some degree, leaving its upper end open and the product exposed to moisture in the ambient air. In this state the product becomes stale in a relatively short period of time.

A variety of devices have been produced to facilitate re-closing these flexible snack food packages. Devices such as clothes pins, clamps, clips, etc. frequently are used by consumers to re-close such packages in an airtight manner. Another solution to this problem has been to provide closure devices which are integral with the snack food package itself. One example of this latter concept is seen in U.S. Pat. No. 4,584,201 (Jan. 20, 1976; Boston) which discloses a resealable package and method of making the same. This patent teaches the application of an adhesive "seal strip" to the external surface of the bag. The seal strip is protected prior to use by a removable release strip. Once the bag is opened, the release strip is removed to expose the adhesive, and the bag is folded down a number times so that the external surface of the bag contacts the adhesive strip and thus cannot unfold.

U.S. Pat. No. 4,428,477 (Jan. 31, 1984; Christofolo) discloses a resealable package for premoistened towelettes. The package is in the shape of an inverted "T", and is re-sealed by folding over the base of the "T" and securing it to an adhesive strip disposed along an outer edge of the package.

Canadian Patent No. 886,404 issued on Nov. 23, 1971 discloses a re-closeable bag having a bendable wire secured longitudinally along the back seam of the bag. The wire is located close enough to the top of the bag so that it is folded along with the upper portion of the bag. The resilient nature of the wire prevents the bag from unfolding.

As far as is known, none of the re-sealable packages having integral closure devices as mentioned above has been widely accepted by either the snack food industry or the consumer. The cost associated with manufacturing such resealable packages has tended to discourage their wide use. The added complexity during film production and during packaging slows production, also leading to increased cost. Thus, there remains a need in the art for a convenient, re-closeable snack food bag that is inexpensive to manufacture, effective and widely accepted by consumers.

SUMMARY OF THE INVENTION

The present invention overcomes the deficiencies of the prior art and satisfies the needs discussed above. The invention provides a resealable package for snack food items constructed from a sheet flexible material. The rear seam of the package, as is common in snack food packages, is formed from the permanent union of two side edges of the sheet of flexible material. The seam extends longitudinally from a top edge to a bottom edge of the package, with a flap of the flexible material protruding therefrom along an exterior side of the package. In accordance with the invention, a strip of a resealable adhesive is disposed adjacent and parallel to the seam, and is spaced therefrom by a distance less than the width of the flap, so that when the flap is folded over it adheres to and substantially covers the adhesive, thus serving as a protective release strip. The flap in the vicinity of the resealable adhesive strip is scored so that it can be easily removed by the consumer to expose the adhesive. The upper portion of the bag is folded over onto the adhesive strip to keep the snack food product fresh, while permitting the package to be opened and then re-sealed a number of times.

In various embodiments of the invention, the rear seam is of the fin-type or lap-type sealing arrangements. Irrespective of the geometry of the seal, the resealable adhesive is disposed beneath the flap of flexible material, so that the flap may serve as a removable, protective release strip.

The invention also provides a method of making a resealable package from a sheet of flexible material. The method comprises uniting two side edges of the sheet into a seam (often referred to as a "seal" in the packaging industry) that extends from a top edge to a bottom edge of the package and which has a flap of material protruding from an exterior side of the package. An adhesive is disposed adjacent and parallel to the seam and spaced from the seam a distance less than the width of the flap. The flap is folded onto the adhesive so that a release agent on the flap contacts the adhesive. In preferred embodiments, the resealable adhesive and release agent are applied in appropriate configuration to the roll stock of flexible material during the converting process. In other embodiments, the adhesive and/or release agent is applied during the packaging process.

The advantages and salient features of this invention will become apparent from the following detailed description, which, taken in conjunction with the drawings, discloses preferred embodiments of the present invention.

DETAILED DESCRIPTION OF THE PREFERRED EMBODIMENT

Figure 1:
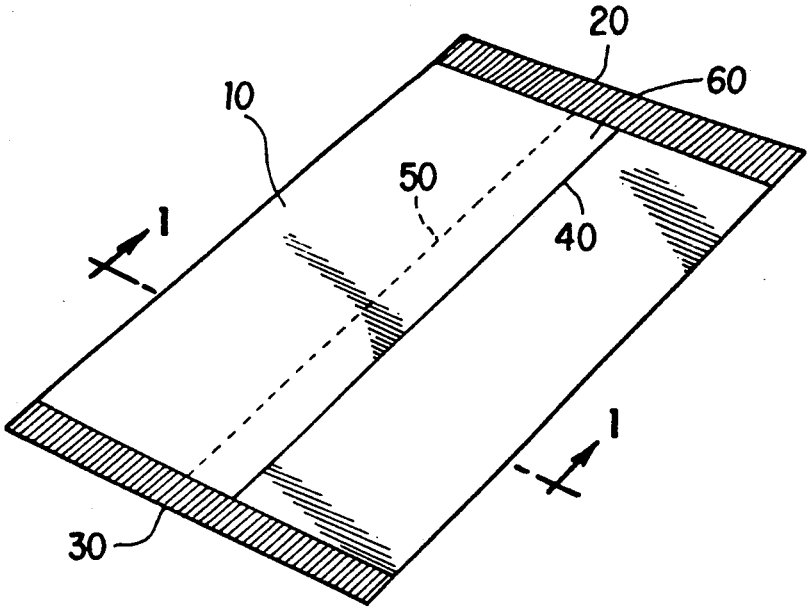
FIG. 1 is a perspective view of an unfilled package in accordance with the invention.

A resealable package according to the present invention is illustrated in FIG. 1 of the drawings and is generally identified by reference numeral 10. While the package 10 is referred to as snack food package, it will be apparent that a variety of other products will benefit from packaging according to this invention.

The package 10 is constructed from a sheet of flexible material in accordance with known industry practice, such as by feeding roll stock over a former in a form-fill-seal apparatus. The package has a top edge 20, a bottom edge 30 and a flap 60 which is created when two side edges 40 and 50 of the flexible sheet are joined together in a permanent sealing arrangement to form a seam. The flap is described as being disposed along the rear side of the package, as this is commonly the case with snack food bags where a clean, uninterrupted front surface is desired. Other orientations of the seam on the package are possible, however, and are within the scope of the invention.

Figure 2A:
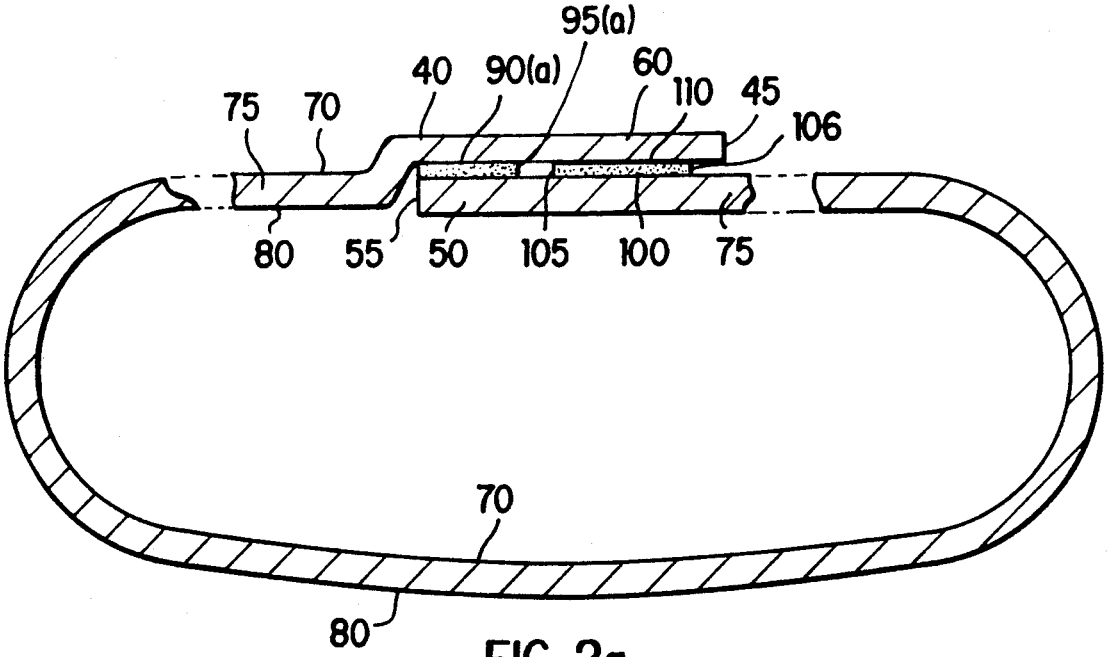
FIGS. 2*a* and 2*b* are sectional views of two embodiments of the invention taken along line 1—1 of FIG. 1.

One embodiment of the invention is described with reference to FIG. 2*a*. FIG. 2*a* illustrates an embodiment wherein the rear seam of package 10 is in the form of what is generally referred to in the art as a lap seal. As seen from the drawing the package is made from a sheet of flexible material 75. The sheet 75 has two side edges 40 and 50 and two surfaces, a first or outer surface 80 and a second or inner surface 70. The lap seal is defined as having the inner surface 70 at side edge 40 permanently joined to the outer surface 80 at side edge 50 to define a seam 90(*a*). Seam 90(*a*) extends along the length of package 10 from the top edge 20 to the bottom edge 30 (see FIG. 1). Seam 90(*a*) is formed by using any of a variety of methods known in the art including heat welding the two surfaces together, or uniting the surfaces by applying a sealant or permanent adhesive therebetween. As known to those skilled in the art, the choice of a sealing method is based on the composition of the sheet material. Heat sealing is usually least expensive and therefore preferred. The width of flap 60 is defined as extending from the end 95(*a*) of seam 90(*a*) to the end 45 of the side edge 40.

In accordance with the invention, the outer surface 80 of the flexible sheet is provided with a resealable adhesive 100 in the vicinity of side edge 50. The adhesive preferably is configured as a strip, parallel to the seam and spaced from the seam by a distance less than the width of flap 60, thus leaving a small gap between end 106 of adhesive 100 and end 45 of side edge 40 as seen in the drawing figure. When the adhesive 100 is disposed in this manner, flap 60 can completely cover it in the manner of a release strip, thus protecting the adhesive prior to use by the consumer.

In order to facilitate the forming-filling-sealing process, the resealable adhesive preferably is applied during production of the roll stock, and appropriate registration during the packaging process will be provided to ensure that the adhesive is properly oriented on the finished package. In the alternative, the adhesive is applied to the flexible sheet material during the form-fill-seal process.

Preferably, the inner surface 70 of flap 60 is coated with a release agent 110. The release agent is disposed on an area on the inner surface 70 of flap 60 corresponding to the adhesive 100 such that the surfaces of the release agent 110 and adhesive 100 are juxtaposed when the flap is folded upon the adhesive. The release agent 110 allows flap 60 to be easily removed from adhesive 100, without damage thereto. The release agent, also, preferably is applied to the flexible material roll stock, but can be applied at the time of packaging if desired.

Figure 2B:
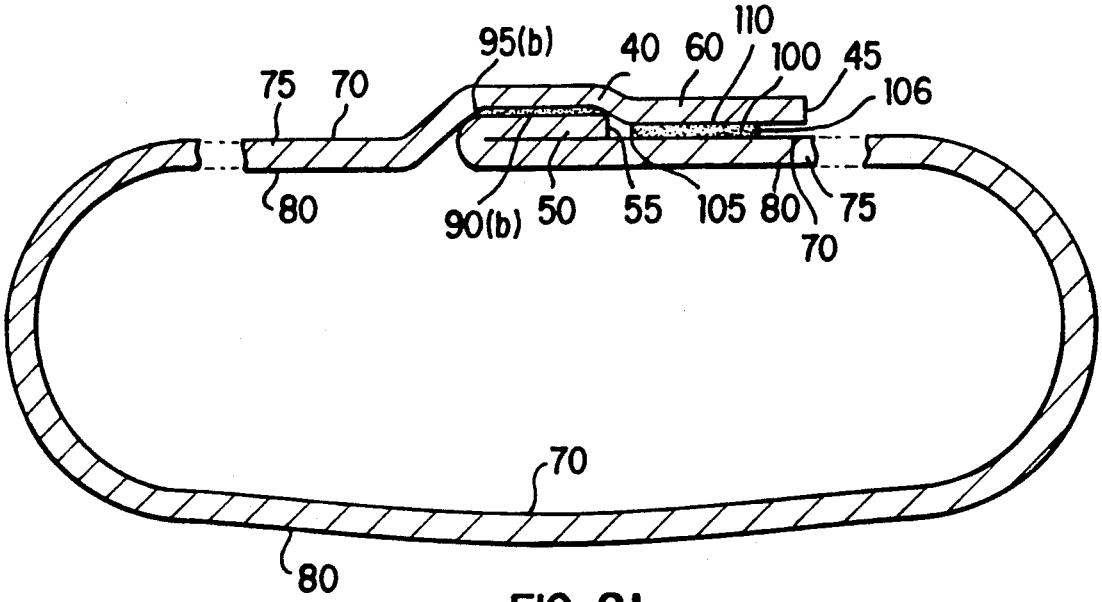

Another embodiment of a package in accordance with this invention is seen in FIG. 2*b*. In this embodiment, the permanent sealing relationship between the side edges 40 and 50 of the flexible sheet is generally referred to in the art as a fin seal. The fin seal is defined as having inner surface 70 of side edge 40 joined to the inner surface 70 of the side end 50, with a flap 60 protruding therefrom. The permanent seam 90(*b*) formed from the union of the side edges extends along the length of package 10 from the top edge 20 to the bottom edge 30 (see FIG. 1). Again, the method of sealing side edges 40 and 50 can be accomplished by well known methods, as mentioned above.

In this embodiment, too, the outer surface 80 of side edge 50 is provided with an adhesive 100 that is located adjacent and parallel to the seam 90(*b*) and spaced from it by a distance less than the width of flap 60, leaving a gap between end 106 of adhesive 100 and end 45 of side edge 40. The inner surface 70 of flap 60 is provided with a release agent approximately equal in size and corresponding to the location of adhesive 100. The surfaces of release agent 110 and adhesive 100 are then juxtaposed when flap 60 is folded upon the adhesive. This allows flap 60 to be easily removed to expose adhesive 100.

Figure 3:
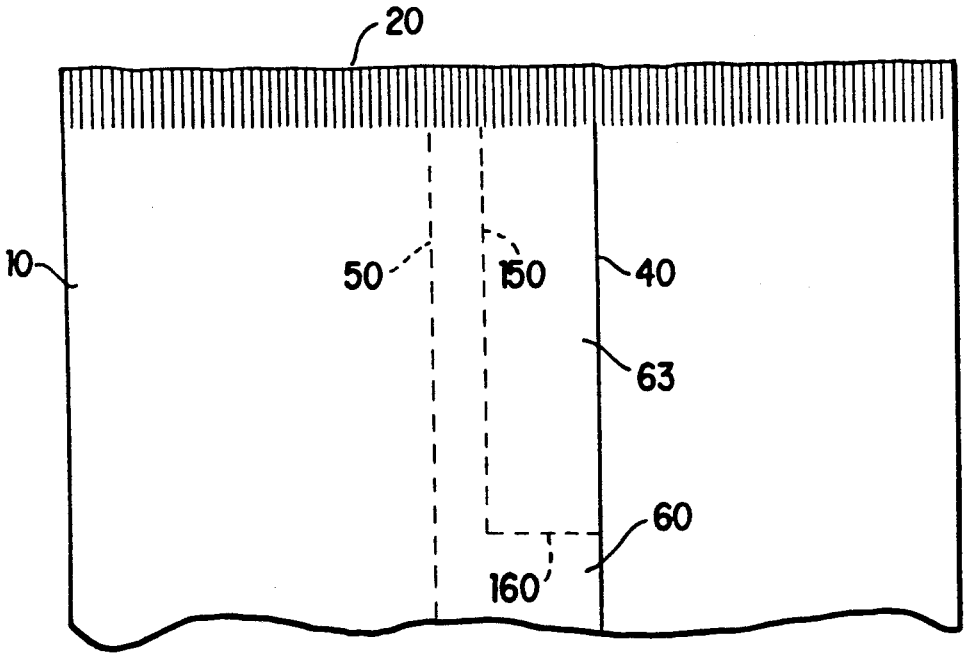
FIG. 3 is a closeup perspective view of the top of the package of FIG. 1.

In one embodiment, shown in FIG. 3, flap 60 is scored in such a way as to produce two score lines 150 and 160, thereby defining a release strip 63. Score line 150 extends along the length of flap 60 substantially from top edge 20 for a distance corresponding to the length of adhesive strip 100. Score line 160 extends from and perpendicular to line 150, preferably reaching the outer edge of flap 60.

For the lap seal configuration shown in FIG. 2*a*, score line 150 is positioned between end 95(*a*) of seam 90(*a*) and end 105 of adhesive 100. For the fin seal configuration shown in FIG. 2(*b*), score line 150 is positioned between end 55 of side edge 50 and end 105 of adhesive 100. In such arrangements, the integrity of seam 90(*a*) will not be compromised when the release strip is removed.

In one version of the lap seal configuration, the width of flap 60 extending from end 95(*a*) of seam 90(*a*) to end 45 of side edge 40 is approximately $\frac{5}{8}$ inches. The width of seam 90(*a*) extending from end 55 of side end 50 to end 95(*a*) of seam 90(*a*) is approximately $\frac{1}{4}$ to $\frac{3}{8}$ inch. The width of resealable adhesive 100, extending from end 105 to end 106 is approximately $\frac{1}{4}$ inch. The distance between end 95 of seam 90(*a*) and end 105 of adhesive 100 is approx. $\frac{1}{4}$ inch. Score line 150 extends from top edge 20 along the length of flap 60 for a distance of 2 to 6 inches, depending on the overall size of the bag.

In one version of the fin seal configuration, the width of flap 60, extending from end 95(*b*) of seam 90(*b*) to end 45 of side edge 40 is approximately $\frac{7}{8}$ inch. The width of seam 90(*b*), extending from end 95(*b*) of seal 90(*b*) to end 55 of side end 50 is approximately $\frac{1}{4}$ inch. The width of resealable adhesive 100 extending from end 105 to end 106 is approximately ¼ inch. The distance between end 55 of side end 50 and end 105 of adhesive 100 is approximately ⅛ to ¼ inch. Score line 150 extends from top edge 20 down towards bottom edge 30 by a distance of 2 to 6 inches, again depending on the overall size of the bag. Score line 150 is also positioned away from end 55 of side edge 50 by a distance of approximately ⅛ inch.

A resealable package of the type described is manufactured from flexible sheet material according to methods well known in the art. The sheet material, for example, is fed from roll stock over a former shoulder to align the material in a circular configuration defining a tube. Side edges 40 and 50 of the sheet are united in a seam, for example by a heated seal bar, to effect a permanent seal, with flap 60 protruding outwardly along the exterior side 80 of the package. The package ends are sealed after the rear seal is formed. While the end of flap 60 will become sealed to the package end as seen in FIG. 3, the flap is lifted away from the bottom seal of the package by the consumer at the time of use.

In preferred embodiments, the resealable adhesive has been pre-applied to the roll stock of flexible material at outer surface 80 of side edge 50. In the finished package, the adhesive is located parallel to the seam and spaced from it by a distance no greater than the width flap 60 while leaving a small gap between end 106 of adhesive 100 and end 45 of side edge 40. The small gap ensures that the edge of flap 60 is free to be lifted from the adhesive by the consumer. A release agent 110 is similarly pre-applied to inner surface 80 of flap 60 in a location corresponding to the location of adhesive 100. Flap 60 is then folded over such that the surfaces of release agent 110 and adhesive 100 are juxtaposed.

Figure 4:
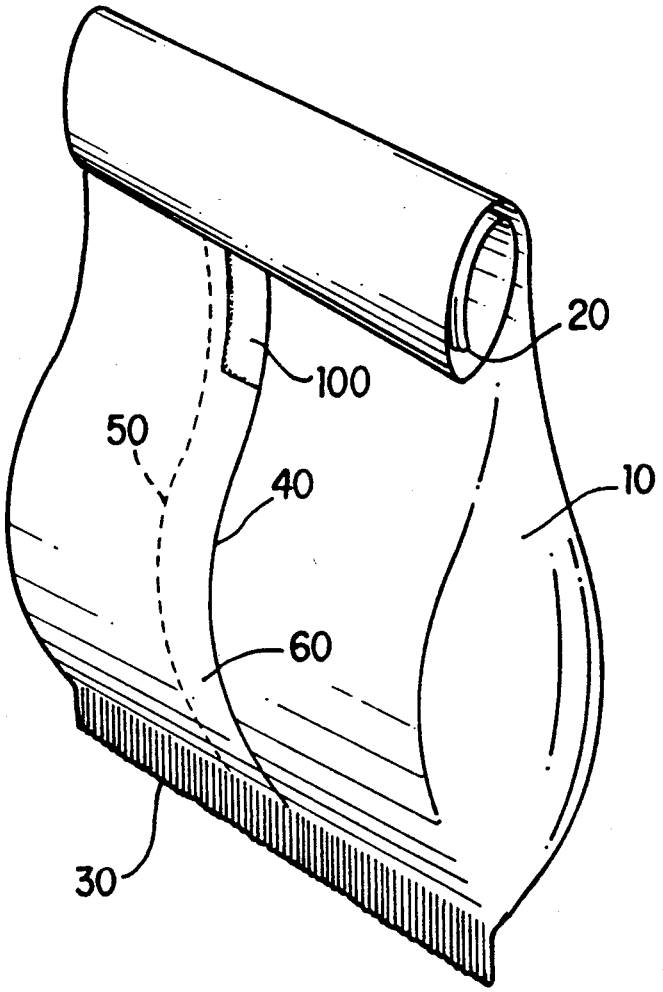
FIG. 4 is a perspective view of the package of FIG. 1 folded over and resealed according to the invention.

Use of the invention will be readily apparent. The consumer will open package 10 at the top end 20 to access the product. When the consumer wants to reclose the package, he will tear away release strip 63 along score lines 150 and 160, thereby exposing the underlying adhesive 100. The package is rolled or folded over number of times from top end 20 toward bottom end 30. The exterior side 80 of package 10 is secured to the adhesive, thus maintaining the package in a closed, substantially airtight configuration. A package secured in this manner is seen in FIG. 4.

The characteristics of the adhesive 100 are selected so that the bag can be opened and closed a number of times over its useful life. Suitable adhesives are well known and used in the packaging industry in the manufacture of packages. Examples include those compatible with polypropylene and polyethylene films, for example. Of course, the adhesive and release agents will be selected so as to be compatible with the packaging materials.

Although the invention has been described in connection with a number of preferred embodiments, it is not so limited. Numerous variations within the scope of the appended claims will be apparent to those skilled in this art.

We claim:

1. A resealable package for a snack food product, comprising a sheet of flexible material having two side edges united in a seam and forming an enclosure for said product, said seam extending longitudinally substantially from a top edge to a bottom edge of the enclosure, with a flap of the flexible material protruding from the seam along an exterior side of the enclosure, and an adhesive disposed adjacent to and parallel to the seam and spaced therefrom by a distance no greater than the width of the flap, with top and bottom ends of the enclosure united in sealing engagement and the flap being sealed at an exterior side of enclosure to said top and bottom ends.

2. A resealable package according to claim 1 wherein the sheet of flexible material has a first surface and a second surface, said seam comprising a lap seal wherein the first surface at one of the side edges is joined to the second surface at the other of the side edges.

3. A resealable package according to claim 2 comprising a release agent disposed on a surface of the flap adjacent to said adhesive.

4. A resealable package according to claim 2 wherein said flap comprises two score lines, a first score line extending parallel to the seam and a second score line extending perpendicular to said first score line.

5. A resealable package according to claim 1 wherein the sheet of flexible material has first surface and a second surface, said seam comprising a fin seal wherein the first surface at one of the side edges is joined to the first surface at the other of the side edges.

6. A resealable package according to claim 3 comprising a release agent disposed on a surface of the flap adjacent to said adhesive.

7. A resealable package according to claim 5 wherein said flap comprises two score lines, a first score line extending parallel to the seam and a second score line extending perpendicular to said first score line.

8. A resealable package according to claim 1 comprising a release agent disposed on a surface of the flap adjacent to said adhesive.

9. A resealable package according to claim 8 wherein said flap comprises two score lines, a first score line extending parallel to the seam and a second score line extending perpendicular to said first score line.

10. A resealable package according to claim 1 wherein said flap comprises a first score line extending parallel to the seam.

11. A resealable package according to claim 1 wherein said flap comprises a second score line extending perpendicular to the seam.

* * * * *

UNITED STATES PATENT AND TRADEMARK OFFICE

CERTIFICATE OF CORRECTION

PATENT NO. : 5,078,509

DATED : January 7, 1992

INVENTOR(S) : John L. Center et al.

It is certified that error appears in the above-identified patent and that said Letters Patent is hereby corrected as shown below:

Col. 6, line 35 (claim 6) "3" should be --5--.

Signed and Sealed this

Seventh Day of September, 1993

*Attest:*

*Attesting Officer*

BRUCE LEHMAN

*Commissioner of Patents and Trademarks*